United States Patent [19]

van den Broek

[11] Patent Number: 4,706,309

[45] Date of Patent: Nov. 17, 1987

[54] AUTOMATIC RIM FLOW WATER LEVEL CONTROL SYSTEM FOR GUTTERS

[75] Inventor: William A. van den Broek, Philadelphia, Pa.

[73] Assignee: KDI Sylvan Pools, Inc., Doylestown, Pa.

[21] Appl. No.: 936,165

[22] Filed: Dec. 1, 1986

Related U.S. Application Data

[63] Continuation-in-part of Ser. No. 817,028, Jan. 8, 1986, abandoned.

[51] Int. Cl.[4] ..... E04H 3/19

[52] U.S. Cl. ..... 4/508; 4/510; 4/512; 210/169

[58] Field of Search ..... 4/508, 512, 507, 510, 4/511; 210/169

[56] References Cited

U.S. PATENT DOCUMENTS

| | | | |
|---|---|---|---|
| 3,155,989 | 11/1964 | Anderson | 4/512 |
| 3,837,015 | 9/1974 | Whitaker | 4/508 |
| 3,968,527 | 7/1976 | Hough | 210/169 X |
| 4,146,937 | 4/1979 | Bakar | 210/169 X |
| 4,206,522 | 6/1980 | Bakar | 4/512 |
| 4,454,035 | 6/1984 | Stefan | 4/508 X |
| 4,483,025 | 11/1984 | Meredith | 4/508 X |
| 4,494,257 | 1/1985 | Peirish | 4/512 X |

*Primary Examiner*—Henry K. Artis

*Attorney, Agent, or Firm*—Z. T. Wobensmith, III

[57] ABSTRACT

An automatic rim flow water level control system for gutters is provided, for use in swimming pools, which includes a peripheral gutter having at least one weir chamber on its pool side wall, the wall having a plurality of vertically extending elongated water entrance slots communicating with the pool weir chamber, a plurality of vertical elongated water exit slots through the top rim of the gutter wall opposite to the pool side water entrance slots, a plurality of elongated water exit slots through the weir chamber wall below the top rim slots, an elongated float carried in the weir chamber, which float is responsive to the water level in the pool, to permit water to flow through the slots into the gutter for skimming, and into the weir chamber for float positioning and water skimming control, the weir chamber bottom wall having orifices to provide for controlled leakage of water out of the chamber into the gutter, from which it is removed, filtered and returned to the pool.

5 Claims, 7 Drawing Figures

AUTOMATIC RIM FLOW WATER LEVEL CONTROL SYSTEM FOR GUTTERS

CROSS-REFERENCE TO RELATED APPLICATION

This application is a continuation-in-part of my prior application Ser. No. 06/817,028, filed Jan. 8, 1986 entitled "Automatic Surge Weir", now abandoned.

BAÇKGROUND OF THE INVENTION

1. Field of the Invention

This invention relates to an automatic rim flow water level control system for swimming pool gutters of the type which includes floats carried in chambers, which floats are responsive to the water level in the pool, to permit of controlled skimming of water from the pool for the full range of design surge capacity, and to provide for the absorbtion of multiple swimmer related sudden wave surges in the pool.

2. Description of the Prior Art

It is well known that institutional swimming pools are required to provide for skimming of water from the pool water surface, so as to remove oils, suntan lotion, and other debris which floats on the water surface, and also must provide for water filtration and make up.

The water surface is skimmed over the poolside gutter wall in a variety of different gutter sytems, which carry the water away to filters and other treatment devices, from which the clean and filtered water is pumped back into the pool, with any required make up water being added thereto.

Health and safety requirements provide for the skimming of pool water not only when the water overflows the rim of the poolside gutter wall, but when the level falls below the top rim to the lowest design surge level, and at specific rates dependent on pool size and health codes. various weir apparatus have been proposed such as is shown in the to Baker U.S. Pat. No. 3,668,713; Whitaker U.S. Pat. No. 3,837,015; Anderson U.S. Pat. No. 3,155,989; Spaulding U.S. Pat. No. 3,813,705; Patterson U.S. Pat. No. 4,173,799; Baker U.S. Pat. Nos. 4,146,937; 4,206,522; Stefan U.S. Pat. No. 4,454,035; Meredith U.S. Pat. No. 4,483,025; and Peirish U.S. Pat. No. 4,494,257, but these and other known devices contain various types of movable gates or members to control the water flow into the gutter, dependent on the water level in the gutter trough.

These and other weir devices are usually of the pivotal type controlled by counterweights or by other external mechanism, which are susceptible to failure, and which devices are *not* controlled by the actual level of water in the pool.

As a result, inadequate or excessive skimming may occur since skimming is dependent on factors such as gutter water level, that are not well defined or consistent with the purpose of skimming the pool water surface when it is both at and below the rim of the poolside gutter wall.

The rim flow water level control system of the invention is automatic, and eliminates the need for a separate surge tank, is automatic, does not require any external controls, since its operation is solely dependent on the level of water in the pool, accommodates wave created surge capacity in the gutter.

SUMMARY OF THE INYENTION

This invention relates to an automatic rim flow water level control system for swimming pool gutters, skimming the dirty water from the pool water surface, at various levels both below and overflowing the top rim of the poolside gutter wall, the poolside gutter wall being provided with a plurality of vertical elongated water entrance slots, and the rim having a plurality of vertically elongated water exit slots, weir chambers fastened to the inside of the gutter in communication with the poolside wall slots and the rim slots, and floats carried in the chambers which control the amount of water flowing into the water entrance and exit slots, and into the gutter dependent on the level of water in the pool. The weir chambers have a plurality of vertical elongated water exit slots, and orifices in the bottom, which orifices permit of controlled leakage of water out of the chambers to assist in maintaining the float levels at desired positions for water skimming.

The principal object of the invention is to provide an automatic rim flow water level control system whose operation is controlled by the water level in the pool.

A further object of the invention is to provide apparatus of the character aforesaid wherein the operation of the system is sutomatic at all design pool water levels and provides for in pool surge capacity.

A further object of the invention is to provide apparatus of the character aforesaid which can be used on a variety of sizes and types of swimming pools.

A further object of the invention is to provide apparatus of the character aforesaid which can be easily fabricated and installed.

A further object of the invention is to provide apparatus of the character aforesaid which requires a minimum of maintenance.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
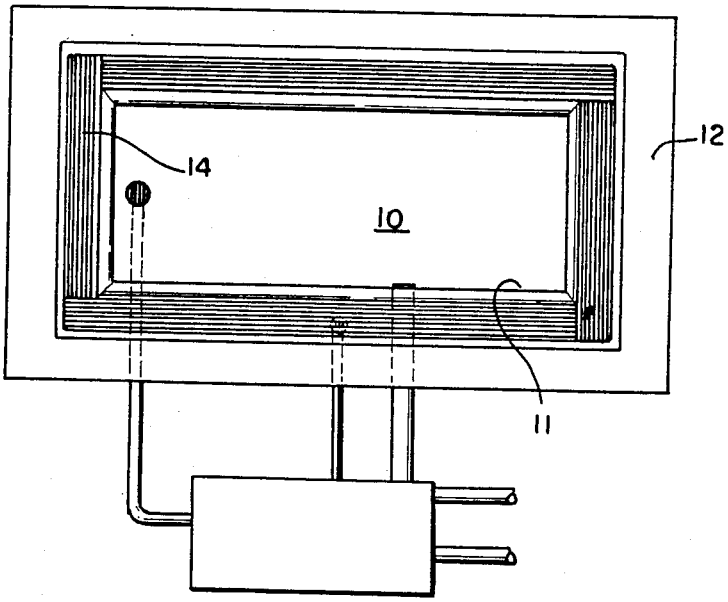
FIG. 1 is a top plan view of a swimming pool and gutter system with the rim flow water level control system incorporated therein.
Figure 2:
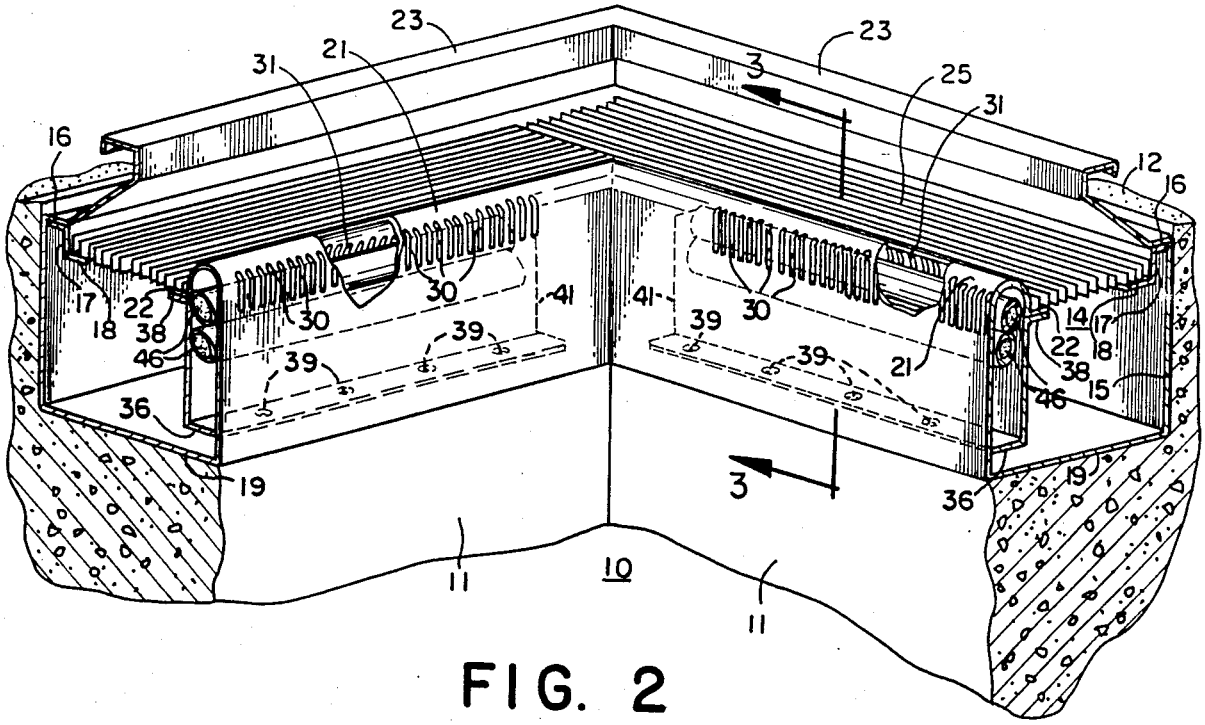
FIG. 2 is a perspective view of the rim flow water level control system of my invention and illustrating it as installed in a typical corner of the gutter system of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings and the FIGS. thereof, a preferred embodiment of the automatic rim flow water level control system for gutters is illustrated, as installed on a concrete pool 10 of well known type. The pool 10 includes vertical walls 11, a perimeter deck 12, and a gutter 14, which is fastened to and extends around the perimeter of the pool in a perimeteral groove 13, formed at the intersection of walls 11 and deck 12.

The gutter 14 is of box-like configuration, open at the top, with vertical rear walls 15, top walls 16 connected to walls 15, vertical downwardly extending inner walls 17 connected to walls 16, and with inwardly extending lips 18 connected to walls 17. The rear walls 15 also have bottom walls 19 connected thereto and extending horizontally forwardly therefrom, with vertically upwardly extending front walls 19 connected thereto, which have semicircular handgrips or rims 21 connected thereto, with horizontally inwardly extending lips 22 attached thereto. The lips 18 and 22 carry slotted grates or cover plates 25 of well known type, with slots 26 to permit water to flow into the interior of the gutter 14.

If desired, the top walls 16 can have additional plate members 23 connected thereto, which extend upwardly and inwardly, and with the pool deck 12 extending thereinto.

The gutter walls 15, 16, 17, 19, 20, 21 and lips 18, and 22 can be constructed of any desired material with stainless steel being preferred for its strength, appearance, and corrosion protection. The grates or cover plates 25 can also be constructed of any desired material, with polyethylene plastic and stainless steel being preferred materials.

The front walls 19 are provided with a plurality of vertical elongated water entrance slots 30, which permit water to flow therethrough, and which slots extend upwardly into a portion of the rims 21, the distance being determined by the design configuration of the particular pool, and including its proposed in pool surge capacity. The rims 21 behind the slots 30 are provided with a plurality of vertical elongated water exit slots 31, which extend down past the lips 22. The slots 30 and 31 are arranged in groups around the pool perimeter, and at each group a weir chamber 35 is provided inside the gutter 14. The weir chambers 35 each include a horizontal bottom wall 36 fastened to gutter front wall 19 by any suitable means, such as welding, a vertical upwardly extending wall 37 connected to the bottom wall 36, and a horizontal wall 38 connected to wall 37 and fastened to the lip 22 by any suitable means, such as spot welding. The bottom walls 36 have a plurality of orifices 39 therethrough, of a selected size, depending on the leakage rate desired from the weir chambers 35 into the gutter 14, with four in number of 5/16 inch diameter being illustrated. The vertical walls 37 have a plurality of vertical elongated water exit slots 40 therethrough, which extend up to the walls 38 to permit water from slots 30, 31 to pass through the slots 40 into the gutter 14.

The weir chambers 35 are closed off at each end by a vertical wall 41, which is connected to walls 19, 36 and 37 thereby forming a chamber that is open at the top, and may receive water from slots 30 and 31 to be described. The weir chamber walls 36, 37, 38 and 41 can be constructed of any desired material with stainless steel being preferred.

Each weir chamber 35 is provided with an elongated float 45 which is of tubular construction, and as illustrated includes two tubes 46, one over the other, secured together at their meeting point 47 by any suitable method, and for polyvinylchloride tubing, the preferred material can be solvent welding in well known manner. The tubes 46 can be filled with any suitable floatation material such as backer rod 47, and the tube ends closed off if desired (not shown) in well known manner.

Figure 5:
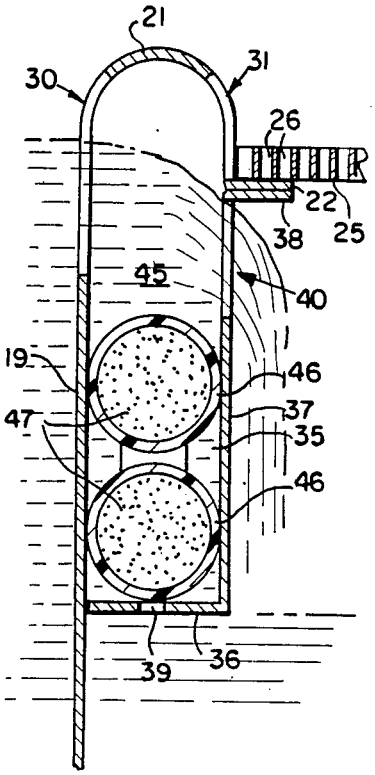
FIG. 5 is a view similar to FIG. 4, but with the pump on, and with the pool water level at the minimum design level.

The mode of operation and use will now be described. The pool 10 in operation is filled with water to the level desired, which may be the level shown in FIG. 5 so that water is just entering the slots 30 in front wall 19, flowing into weir chambers 35, flowing out slots 40 and into the interior of the gutter 14, thereby skimming the pool water surface. The float 45 is resting on the bottom wall 36 and the gutter water level is shown at the bottom of the wall 36.

Figure 6:
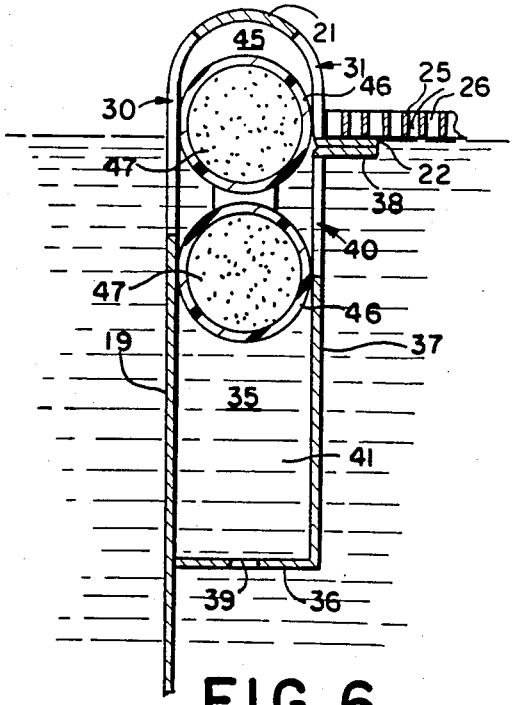
FIG. 6 is a view similar to FIG. 5 with the pool water level at an intermediate skimming level, and with the pump off so that no water is being withdrawn from the gutter which is in a flooded condition.
Figure 7:
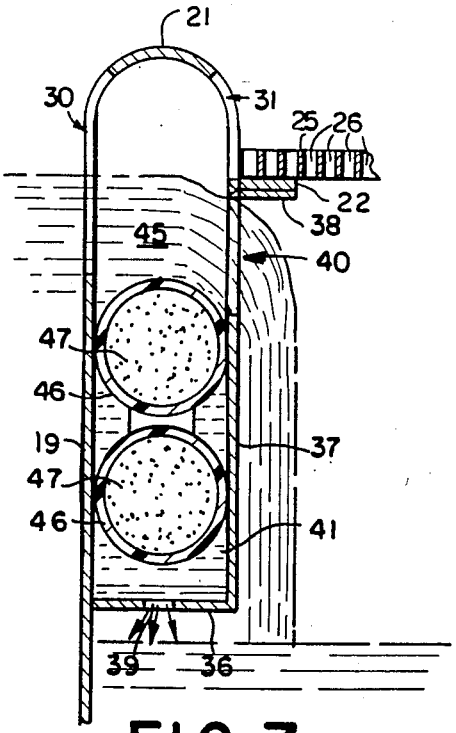
FIG. 7 is a view similar to FIG. 6, but with the pump on, the pool in quiescent state, and the float in operating buoyancy, with water being withdrawn from the gutter, filtered and returned to the pool.

The float 45 will then rise to the position shown in FIG. 6, which allows water at the design capacity to flow into slots 30, out 31 and 40, into the gutter 14, and which corresponds to a quiescent state.

If the pump (not shown) is turned off as shown in FIG. 6, then the water level in gutter 14 rises, and the float 45 will rise to its buoyancy level as shown in FIG. 6, the gutter will become flooded, and the gutter water level will rise to the pool surface water level.

Figure 3:
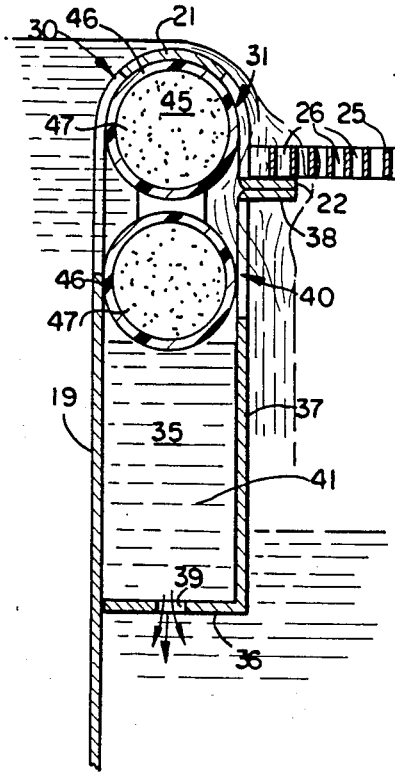
FIG. 3 is a vertical sectional view, enlarged, taken approximately on the line 3—3 of FIG. 1, illustrating the system of my invention in operation at the maximum water overflow condition of overflowing the top rim of the pool gutter.
Figure 4:
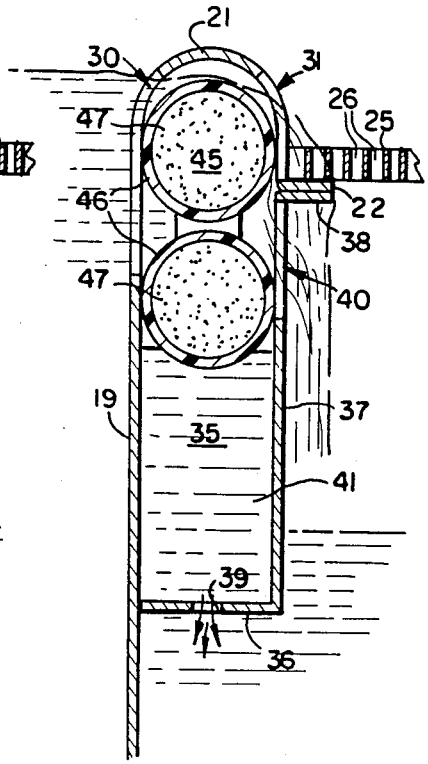
FIG. 4 is a view similar to FIG. 3, but with the pool water level below the top rim of the gutter.

As the pool 10 is occupied by swimmers (not shown), the water level rises as shown in FIG. 4, with the float 45 also rising due to the greater amount of water entering the slots 30, which causes the floats 45 to rise, with water filling the chambers 35 below the floats 45. As shown in FIG. 3, if the water continues to rise, the float 45 reaches the position shown in FIG. 3, where the pool water is overflowing the top of rims 21, and the floats 45 move upwardly and close off water flow through slots 30, so that all of the water flow over the top of the rims 21 into gutter 14 through the slots 30. As the pool water level rises and falls, due to the displacement of the swimmers (not shown), the floats 45 will rise and fall permitting a greater or lesser amount of water to be skimmed through slots 30 and into gutter 14.

In should be noted that in the condition as shown in FIG. 3 with the water overflowing rim 21, the gutter water level is below the bottom walls 36 of weir chambers 35, so that the gutter 14 can absorb additional water due to wave action overflowing the rim 21. The wave or sudden water surge is absorbed in the gutter 14, does not splash out and does not interfere with the swimmers, and is carried away by the normal water removal and circulation system (not shown).

It will thus be seen that an automatic rim flow water level control system for gutters has been provided with which the object of the invention are achieved.

I claim:

1. An automatic rim flow water level control system for swimming pools gutters which is responsive to the level of water in the pool, said pool including a perimeter gutter having a front wall with a rim, which system comprises at least one weir chamber open at the top and engaged with the front wall of the gutter, a plurality of vertical elongated water entrance openings through the front wall of the gutter, a plurality of vertical elongated water exit openings through the rim of the gutter behind the front wall slots, said weir chamber having a rear wall, a plurality of vertically elongated water exit openings in said chamber rear wall, said weir chamber having a horizontal bottom wall, said chamber having vertical end walls connected to said rear float carried in said weir chamber, said float's position in said chamber being responsive only to said pool water level, and thereby determining the flow of water into said entrance slots and out said exit slots into said gutter for removal, and said bottom wall, and controlled water leakage means in said bottom wall to permit water to exit said gutter below said float to prevent said float from becoming water bound.

2. An automatic rim flow water level control system for gutters as defined in claim 1 in which said front wall openings extend into said rim a predetermined distance, and said rim gutter openings extend into said rim a predetermined distance.

3. An automatic rim flow water level control system for gutters as defined in claim 1 in which said float is of tubular construction and filled with floatation material.

4. An automatic rim flow water level control system for gutters as defined in claim 1 in which said controlled water leakage means is a plurality of openings in said bottom wall of said chamber.

5. An automatic rim flow water level control system for gutters as defined in claim 1 in which said gutter and said weir chamber are constructed of stainless steel.

* * * * *

UNITED STATES PATENT AND TRADEMARK OFFICE

CERTIFICATE OF CORRECTION

PATENT NO. : 4,706,309

DATED : NOVEMBER 17, 1987

INVENTOR(S) : WILLIAM A VAN DEN BROEK

It is certified that error appears in the above-identified patent and that said Letters Patent is hereby corrected as shown below:

Column 1

Line 40, "various" should be - Various -.

Column 2

Line 2, Inyention" should be - invention -.

Claims, Column 5

Line 22, after "and" the balance of the line should be deleted.

Signed and Sealed this

Third Day of May, 1988

*Attest:*

*Attesting Officer*

DONALD J. QUIGG

*Commissioner of Patents and Trademarks*